US006290531B1

(12) United States Patent
Onizuka et al.

(10) Patent No.: US 6,290,531 B1
(45) **Date of Patent: *Sep. 18, 2001**

(54) ELECTRIC CABLE AND CONNECTOR FOR USE WITH A CRAMPING TERMINAL

(75) Inventors: Takahiro Onizuka; Nori Inoue; Yoshito Oka; Yuuki Saka; Makoto Kobayashi, all of Yokkaichi (JP)

(73) Assignee: Sumitomo Wiring Systems, Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/575,517

(22) Filed: Dec. 20, 1995

(30) Foreign Application Priority Data

Dec. 20, 1994 (JP) ..... 6-335729

(51) Int. Cl.[7] ..... H01R 4/24

(52) U.S. Cl. ..... 439/397; 439/395

(58) Field of Search ..... 174/117 R; 439/395–408

(56) References Cited

U.S. PATENT DOCUMENTS

| | | | | |
|---|---|---|---|---|
| 3,383,456 | * | 5/1968 | Kosak | 174/117 R |
| 3,621,118 | * | 11/1971 | Bunish et al. | 174/117 R |
| 3,816,818 | | 6/1974 | Meier . | |
| 3,994,554 | | 11/1976 | Navarro . | |
| 4,673,904 | * | 6/1987 | Landis | 174/117 R |
| 4,692,566 | * | 9/1987 | Kauffman | 174/117 R |
| 5,304,741 | * | 4/1994 | Proulx | 174/117 FF |
| 5,399,098 | * | 3/1995 | Marshall et al. | 439/397 |

FOREIGN PATENT DOCUMENTS

| | | |
|---|---|---|
| 9102716 | 3/1991 | (DE) . |
| 2095481 | 9/1982 | (GB) . |

* cited by examiner

*Primary Examiner*—Gary F. Paumen
(74) *Attorney, Agent, or Firm*—Bierman, Muserlian and Lucas

(57) ABSTRACT

A cable includes a conductive wire, preferably of copper, and an insulating sheath, preferably of synthetic resin, covering the wire. The conductive wire has, for example, a rectangular cross section. The cable can be pressed into a slit of a cramping terminal with an improved operability and a temperature increase of the conductive wire 21 can be suppressed.

2 Claims, 5 Drawing Sheets

ELECTRIC CABLE AND CONNECTOR FOR USE WITH A CRAMPING TERMINAL

This Application claims the priority of Japanese Application 6-335729, filed Dec. 20, 1994.

The present Invention is an improvement on single-core or multi-core electric cables for use with a cramping terminal which includes a conductive wire which is to be pressed into a slit formed therein. The present Invention also relates to an electric connector comprising one or more of the foregoing cables.

BACKGROUND OF THE INVENTION

A known cable of this type is shown in FIGS. 7 and 8. It consists essentially of conductive wire 1 having a circular cross section and insulating sheath 2 covering wire 1. When this cable is pressed into slit 3*a* in cramping terminal 3, edges of slit 3*a* penetrate insulating sheath 2 and linearly cut into the outer portion of conductive wire 1, thereby making electrical contact therewith.

In such a structure, if the contact area between wire 1 and slit 3*a* is smaller than the cross section of wire 1, the electrical resistance of the contact portion is larger than that of wire 1. This is not desirable because it causes local generation of heat. Considering the thickness of the plate forming cramping terminal 3, the diameter of conductive wire 1, the rate of deformation of the conductive wire as it is pressed into the slit, as well as other factors, width W of slit 3*a* of terminal 3 is such that the contact area between conductive wire 1 and cramping terminal 3 is larger than the cross section of conductive wire 1. To accomplish this, width W must be considerably smaller than the diameter of conductive wire 1. Particularly, when a thick conductive wire 1 is used, the lateral edges of slit 3*a* cut more deeply into the outer portion of conductive wire 1. Thus, a greater pressing force is required, making the cable pressing operation more difficult.

Comparing an electrical wiring using the cables and the cramping terminals of this type with a busbar type wiring using conductive plates as conductors, the temperature of the conductors increases to a greater extent in the former wiring, thereby necessitating measures to cope therewith. The temperature increase is greater in the former case because the surface area of the conductive wire having a circular cross section is smaller than that of the busbar having a rectangular cross section, provided, of course, that both cross sections have the same total area.

SUMMARY OF THE INVENTION

In view of the above problem, it is the object of the Invention to provide an electric cable for use with a cramping terminal and an electrical connection means comprising the above electric cable with an improved operability and in which the temperature increase of the conductive wire is minimized.

According to the Invention, the cable for use with the cramping terminal includes a conductive wire which has a polygonal cross section, preferably having at least four sides. If the conductive wire is polygonal in cross section with an even number of sides, two opposing sides are parallel to each other. In this case, the cable is pressed into the slit of the cramping terminal with the two opposing sides in contact with the corresponding lateral edges of the slit. This minimizes the portion of the conductive portions to be cut by the sides of the slit, thereby making the force required to press the cable into the slit of the cramping terminal smaller. Further, since the two opposite sides contact the entire lateral edges of the slit, the density of the current flowing through the contact portions becomes smaller, thereby minimizing local generation of heat. When the conductive wire has a polygonal cross section having an odd number of sides, the two opposing sides are not parallel. However, the outer portion of the conductive wire to be cut by the slit is still less than with a conductive wire having a circular cross section.

Thus, because the outer portion of the conductive wire which is to be cut by the slit is reduced, less force is required to press the cable into the slit and thereby complete the connection. Moreover, since the opposing sides of the wire contact the sides of the slit along their entire length, the contact area is larger than with the usual circular cross section wires. Therefore, the amount of heat generated per unit area is correspondingly reduced, thereby controlling the local heat generated. Furthermore, if there are two wires having the same cross sectional area, the one with a polygonal cross section will have a larger surface than one with a circular cross section. As a result, the polygonal wires of the present Invention are able to radiate more heat than the circular wires. As a result of all three of the foregoing factors, assembly of the connector is facilitated and the heat problem is minimized.

According to preferred embodiments of the Invention, the polygonal cross section has four or more sides, and is preferably rectangular, pentagonal, or hexagonal. It is also preferred that the polygonal cross section having an even number of sides be equilateral, and the polygonal cross section having an odd number of sides be non-equilateral. The polygonal cross section having an odd number of sides advantageously has two approximately parallel sides which are longer than the other sides.

According to a further embodiment of the Invention, the electric cable also comprises at least two conductive wires, wherein the insulation sheaths of adjacent electric wires are formed integrally, and the conductive wire desirably comprises a plurality of twisted and/or compressed strands. Furthermore, the insulating sheath preferably has a polygonal outer shape, in particular one corresponding to the polygonal cross section of the conductive wire.

According to the Invention, there is also provided an electric connector comprising at least one electric cable according to the Invention and at least one cramping terminal, wherein the conductive wire is pressed into a slit formed in the terminal. According to a preferred embodiment of the Invention, the electric connector comprises at least two electric cables and a cramping terminal bus having at least two cramping terminals, wherein each conductive wire is insertable into a slit formed in a corresponding cramping terminal. Preferably, the slit of each cramping terminal has a width equal to or slightly smaller—preferably by about several tenths of a millimeter—than the width of the conductive wire.

In the accompanying drawings, constituting a part hereof and in which like reference characters indicate like parts, FIG. 1 is a perspective view showing the cable and connector of the Invention;

Figure 1:
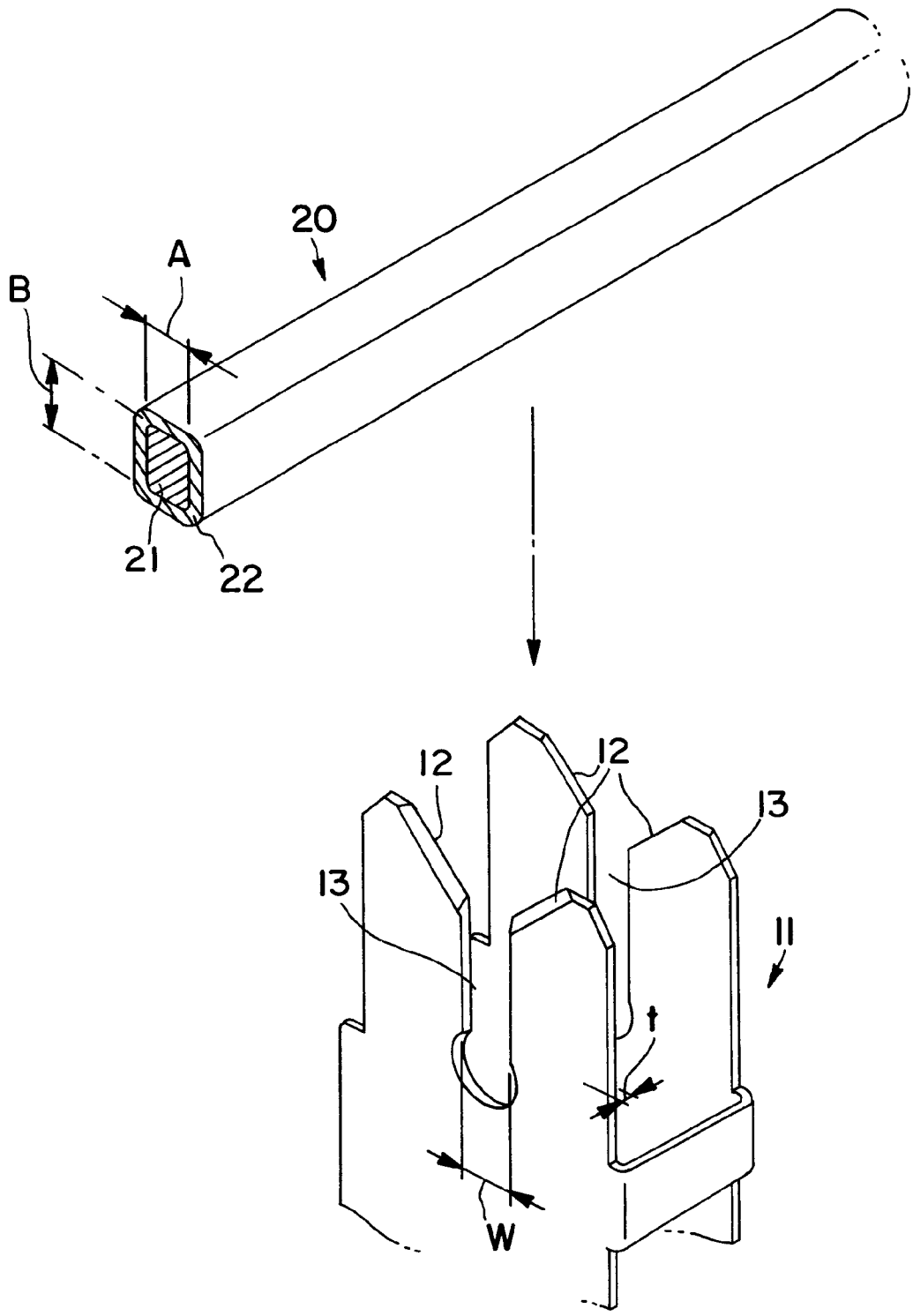
Figure 2:
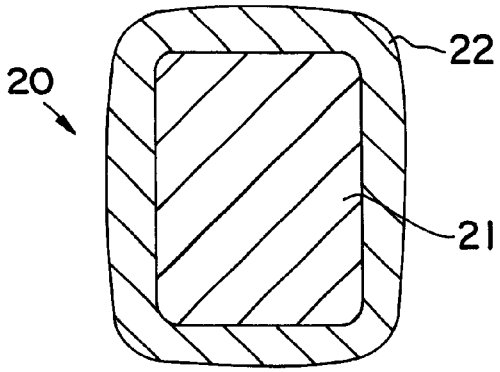
FIG. 2 is an enlarged cross section of the cable according to the Invention.
Figure 3:
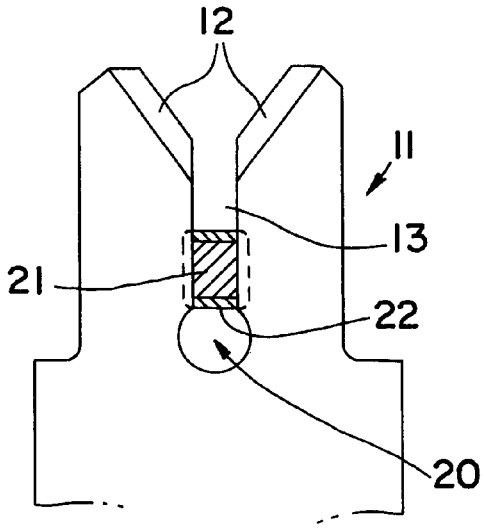
FIG. 3 is a section showing the cable of FIG. 2 pressed into the slit of a cramping terminal.

With reference to FIGS. 1 and 3, cramping terminal 11 has lateral edges of slit 13 which extend linearly downward and continuously from a pair of tapered cutters 12. Cable 20 comprises conductive wire 21, preferably of copper, covered with insulating sheath 22, preferably of synthetic resin. Conductive wire 21 has, for example, a rectangular cross section as shown in FIG. 2. Cable 20, which is produced according to a known method, has a width or length A of its shorter side slightly (e.g. by 0.2 mm) larger than width W of slit 13 of cramping terminal 11 (A=W+0.2 mm).

When cable 20 is pressed into slits 13 of cramping terminal 11, it is positioned so that the longer sides of the cross section extend along the cable pressing direction and are pressed against tapered cutters 12. Then, cable 20 slips into slits 13 while insulating sheath 22 thereof is penetrated by tapered cutters 12. Since length A is slightly larger than width W of slits 13, the lateral side portions of conductive wire 21 of cable 20 are only slightly cut by the lateral edges of slits 13, thereby establishing an electrical contact between conductive wire 21 and cramping terminal 11.

In such a state, since conductive wire 21 has a vertically long rectangular cross section, it is in contact with cramping terminal 11 substantially entirely along its entire longer sides B. Accordingly, if t denotes a thickness of the plate forming cramping terminal 11, contact area Ac is: $Ac=2\times B\times t$. This means that a larger contact area is assured compared to a conductive wire, with the same cross section, having a circular cross sectional area. Thus, local generation of heat can be prevented by lowering a contact resistance or electrical resistance of the contact.

Figure 9A:
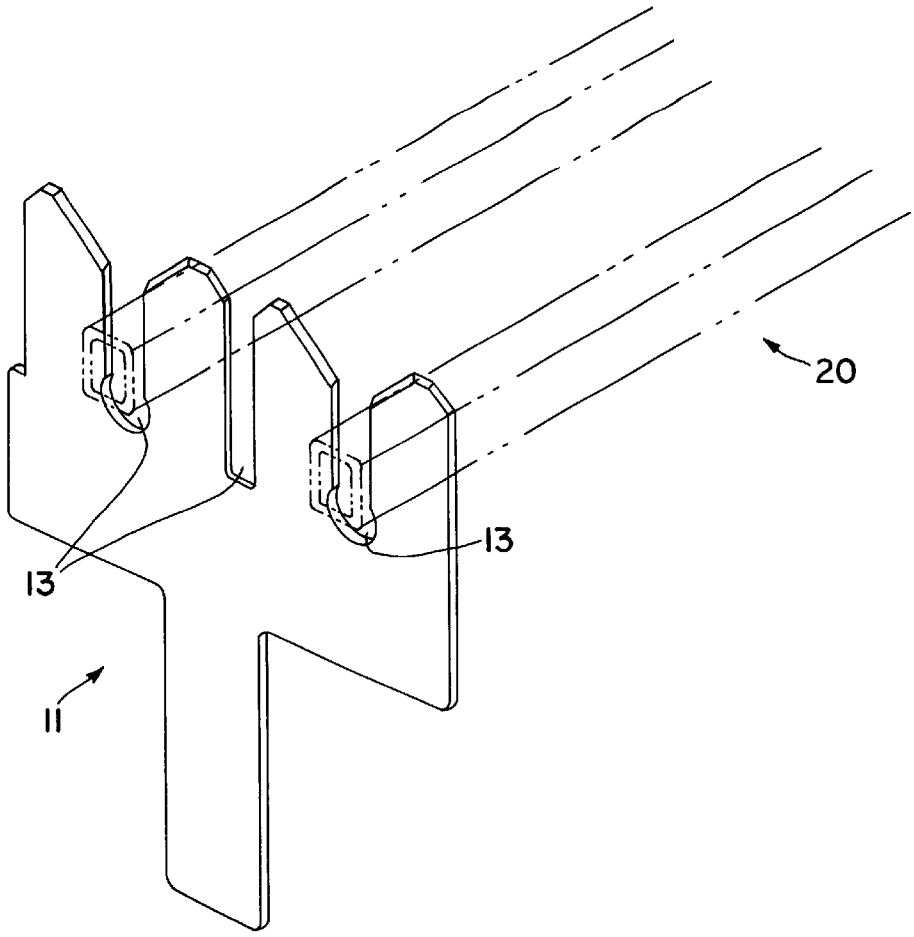
FIGS. 9A and 9B are perspective views of a modification of the Invention.
Figure 9B:
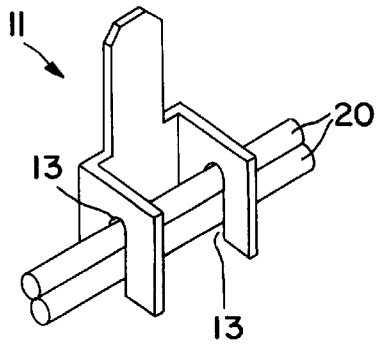

Further, since cable 20 is pressed into slits 13 of cramping terminal 11 with the longer sides of the cross section of conductive wire 21 along the cable pressing direction, the outer portion of conductive wire 21 is not deeply penetrated by slits 13. Therefore, only a small force is required to press cable 20 into slits 13. The cable pressing operation can thus be easily performed. A further embodiment of the Invention is shown in FIGS. 9A and 9B. There are two cables 20 and two corresponding slits 13 in cramping terminal 11.

Moreover, since conductive wire 21, having a rectangular cross section, has a larger surface area than a conductive wire having a circular cross section of the same cross sectional area, an increased amount of heat can be radiated from the surface, thereby minimizing heat build up.

Figure 4:
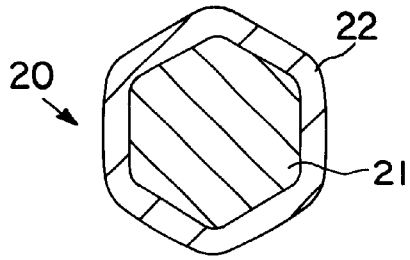
FIG. 4 is a section of another embodiment of the inventive cable.
Figure 5:
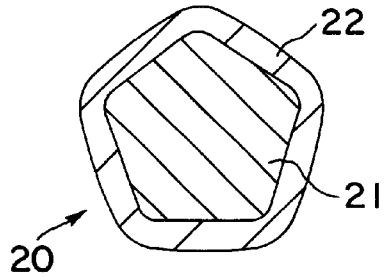
FIG. 5 is a section of a further embodiment of the inventive cable.
Figure 6:
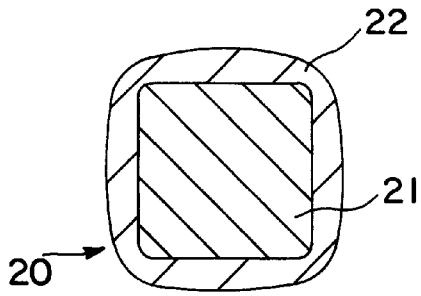
FIG. 6 is a section of a still further embodiment of the inventive cable.
Figure 7:
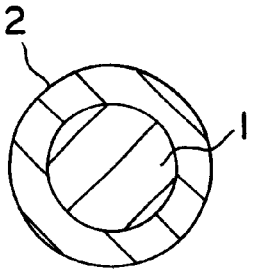
FIG. 7 PRIOR ART
FIG. 7 is a section of a prior art cable.
Figure 8:
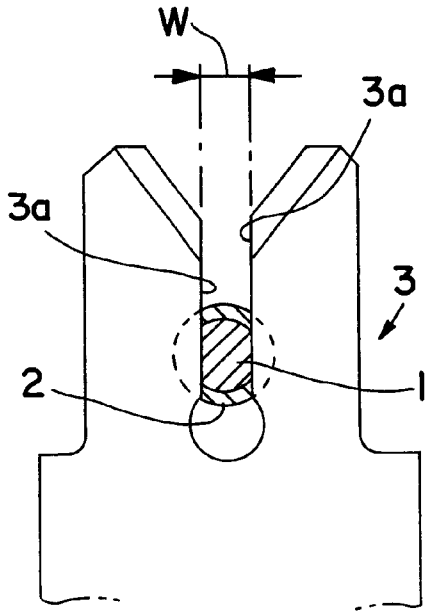
FIG. 8 PRIOR ART
FIG. 8 is a section of the prior art cable pressed into a slit of a cramping terminal.

Although the cross section of the conductive wire is rectangular in the foregoing embodiment, it may be square, pentagonal, or hexagonal as shown in FIGS. 4 to 6. In other words, it is sufficient that the conductive wire have any polygonal cross section having four or more sides. Furthermore, the present Invention is not limited to the embodiments described and shown in the drawings, but may be embodied in several forms without departing from the spirit and scope thereof.

What is claim is:

1. One electrically conductive cable, and a cramping terminal for use therewith, said cable comprising one electrically conductive wire, an insulating sheath surrounding said wire, said wire having a rectangular cross section with four sides, two long said sides opposing one another and being parallel to one another, said terminal having at least one slit with a bottom and an open outer end, said slit defined by a pair of parallel edges spaced apart by a first distance which is about 0.2 mm less than a second distance between said two long opposing sides of said wire, one cutter on each of said edges cutting into said sheath and contacting said wire such that said two opposing long sides are entirely in contact with corresponding lateral edges of said slit.

2. The cable and clamping terminal of claim 1 wherein there are two said slits spaced apart in a direction normal to a plane of one said slit.

* * * * *